US007122755B2

(12) United States Patent
Ito

(10) Patent No.: US 7,122,755 B2
(45) Date of Patent: Oct. 17, 2006

(54) SWITCH DEVICE HAVING OPERATION MEMBER WHICH IS NOT EASILY DISENGAGED FROM HOUSING EVEN WHEN LARGE AMOUNT OF LOAD IS APPLIED

(75) Inventor: Chieko Ito, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/338,258

(22) Filed: Jan. 24, 2006

(65) Prior Publication Data

US 2006/0163052 A1 Jul. 27, 2006

(30) Foreign Application Priority Data

Jan. 27, 2005 (JP) ..... 2005-019165

(51) Int. Cl.
*H01H 3/00* (2006.01)

(52) U.S. Cl. ..... 200/339; 200/5 R; 200/553

(58) Field of Classification Search ..... 200/1 R, 200/5 R, 18, 293–295, 339, 553, 556
See application file for complete search history.

(56) References Cited

U.S. PATENT DOCUMENTS 5,105,059 A * 4/1992 Sorenson et al. ..... 200/302.3
5,414,231 A * 5/1995 Sato et al. ..... 200/1 R
5,821,483 A * 10/1998 Yamaguchi et al. ..... 200/5 R
5,860,516 A * 1/1999 Geppert ..... 200/553
6,054,655 A * 4/2000 Rudolph et al. ..... 200/16 R
6,191,372 B1 2/2001 Sasaki et al.
6,559,398 B1 * 5/2003 Takeda et al. ..... 200/339

* cited by examiner

*Primary Examiner*—K. Lee
(74) *Attorney, Agent, or Firm*—Brinks Hofer Gilson & Lione

(57) ABSTRACT

A switch device includes a switch housing having an operation member receiving part and an operation member which is mounted on the operation member receiving part of the switch housing as the main components. The switch housing has a regulation wall between an engaged region and a predetermined region X where a front end of the operation member is brought into contact with the switch housing by a seesaw operation of the operation member. The regulation wall is positioned such that the regulation wall facingly contacts an extension part of the operation member in a state in which the extension part of the operation member is in contact with the top surface (predetermined region X) of the switch housing, and the regulation wall does not facingly contact the extension part of the operation member when the operation member is mounted on the switch housing.

4 Claims, 4 Drawing Sheets

SWITCH DEVICE HAVING OPERATION MEMBER WHICH IS NOT EASILY DISENGAGED FROM HOUSING EVEN WHEN LARGE AMOUNT OF LOAD IS APPLIED

BACKGROUND OF THE INVENTION

1. Field of the Invention

The present invention relates to a switch device, more particularly, to a switch device suitable for an operating motor for driving, for example, a power window.

2. Description of the Related Art

Various types of switch devices have been manufactured according to various purposes in the related art. Of those switch devices, a switch device for driving a motor, mainly, a motor for a power window for a vehicle is disclosed in JP-A-2000-348569 (U.S. Pat. No. 6,191,372). FIGS. 5A and 5B are views showing the construction of a switch device according to the related art. FIG. 5A is a perspective view showing an operation member, and FIG. 5B is a cross-sectional view of a switch housing on which the operation member is mounted.

The switch device is constructed of a switch knob 102 mounted on a switch housing 110, and the switch housing 110 which is mounted on a panel 100 having a switch accommodation part 100*a*. Specifically, as a protrusion 100*c* extending outwardly from a wall 100*b* of the switch housing 110 is engaged with a hole 102*a* formed at a side wall of the switch knob 102, the switch knob 102 is mounted on the switch housing 110. In this switch device, by operating the switch knob 102 in a direction indicated by an arrow in FIG. 5A, the switch knob 102 seesaws about the engaged region as a fulcrum. Accordingly, a motor can be driven in the normal or reverse direction.

However, when a force is applied in an upward direction of the arrow shown in FIG. 5A, a front end 102*b* of the switch knob 102 is brought into contact with the surface of the switch housing 110. When a force is applied in a direction which lifts up a rear end 102*c* about a contact Y of the switch housing as a fulcrum, a large amount of force is applied on a region between the bottom surface of the protrusion 100*c* and a lower part of the inner peripheral surface partitioning the hole 102*a*, and accordingly, a slip therebetween occurs. Thus, the switch knob 102 is deformed so that the front end (opening end) of the switch knob 102 widens. Therefore, the protrusion 100*c* is disengaged from the hole 102*a*, and eventually, the switch knob 102 is disengaged from the switch housing 110.

Parts facing the protrusions 100*c* of the switch housing 110 can prevent the switch knob 102 from extending outward to some degree. However, the switch knob 102 is disposed at a free end side with respect of the switch housing 110, and thus the switch knob 102 can be easily deformed. Further, it is difficult to reliably prevent the switch knob 102 from extending outward since there are accuracy problems when the switch knob 102 is mounted on the switch housing 110. In this structure, there is also a problem in that formation of the panel 100 is limited.

SUMMARY OF THE INVENTION

The invention has been finalized in view of the drawbacks inherent in the switching device according to the related art, and it is an object of the invention to provide a switch device capable of preventing an operation member from being disengaged even though an excessive amount of load is applied thereon.

According to a first aspect of the invention, a switch device includes a switch housing having an operation member receiving part composed of walls having first engaging parts, and an operation member which has second engaging parts engaged with the first engaging parts, covers the operation member receiving part by snap-engaging the second engaging part with the first engaging part by a snap relationship, and is mounted on the switch housing such that the operation member seesaws about an engaged region of the first and second engaging parts as a fulcrum. In this case, the switch housing has a regulation wall between the engaged region and a predetermined region where an end of the operation member is brought into contact with the switch housing by the seesaw operation, the regulation wall regulating deformation of the operation member and/or the switch housing.

With this structure, when an excessive amount of load is applied on the operation member, the deformation of the operation member and/or the switch housing can be suppressed by the regulation wall. Accordingly, the operation member is prevented from being disengaged from the switch housing. Moreover, by disposing the regulation wall between the predetermined region and the engaged region, when the operation member is mounted on the switch housing, the regulation wall does not disadvantageously affect the mounting operation.

In the switch device, preferably, the regulation wall prevents deformation in a direction which allows the second engaging part to be disengaged from the first engaging part, in a state in which the operation member is in contact with the switch housing. With this structure, the regulation wall can prevent deformation in a direction which allows the second engaging part to be disengaged from the first engaging part. For example, the operation member can be prevented from deforming outward by the regulation wall when the second engaging part is disengaged from the first engaging part.

Further, in the switch device, preferably, the distance between the operation member and the regulation wall is set to be shorter than the length by which the first engaging part is engaged with the second engaging part.

With this structure, before the second engaging part is disengaged from the first engaging part, the regulation wall can prevent the operation member from deforming outward; therefore, the operation member can be reliably prevented from being disengaged from the switch housing.

Furthermore, in the switch device, preferably, the first engaging part is a recessed part, and the second engaging part is a protruding part. Accordingly, since it is not necessary to form a hole in the switch housing, it is possible to prevent, for example, moisture, from permeating into the switch housing.

According to the switching device described above, the switch device includes the switch housing having an operation member receiving part composed of walls having first engaging parts, and an operation member which has second engaging parts to be engaged with the first engaging parts, covers the operation member receiving part by snap-engaging the second engaging part with the first engaging part, and is mounted on the switch housing such that the operation member seesaws about an engaged region of the first and second engaging parts as a fulcrum. In this case, the switch housing has a regulation wall between the engaged region and a predetermined region where an end of the operation member is brought into contact with the switch housing by the seesaw operation, the regulation wall regulating deformation of the operation member and/or the switch housing. Therefore, even though an excessive amount of load is applied on the operation member, the operation member can be prevented from being disengaged from the switch housing.

BRIEF DESCRIPTION OF THE DRAWINGS

FIG. 5 is a view showing the construction of a switch device according to the related art.

DESCRIPTION OF THE PREFERRED EMBODIMENT

Figure 1:
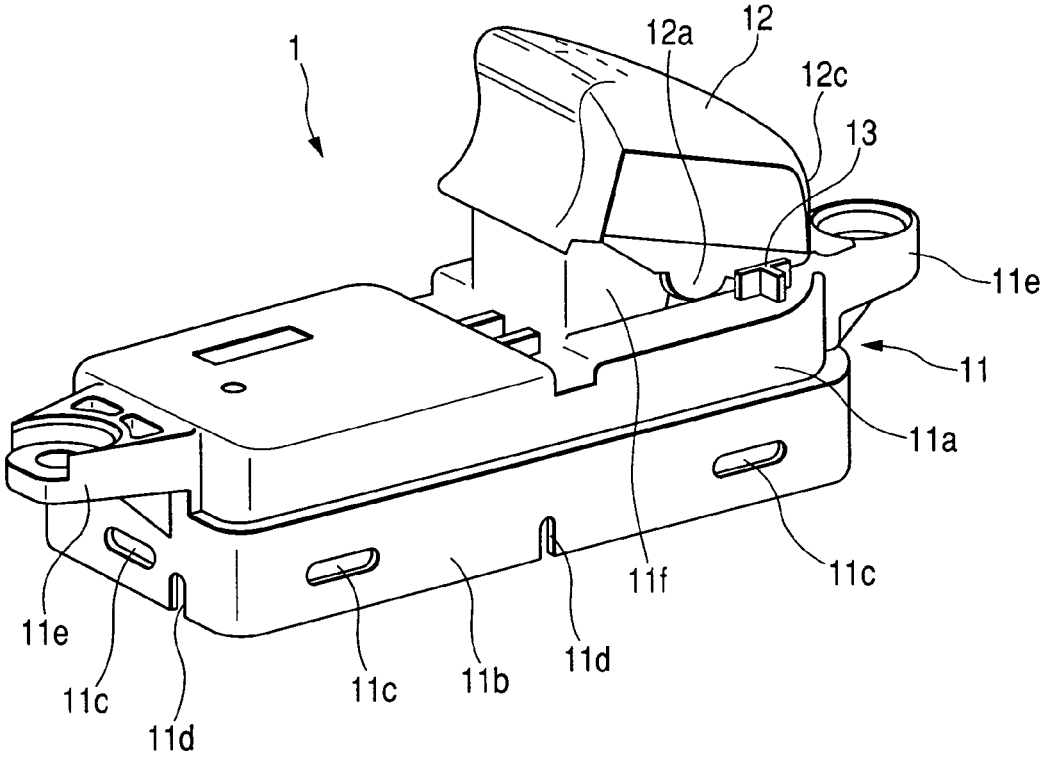
FIG. 1 is a perspective view showing the construction of a switch device according to an embodiment of the invention.
Figure 2A:
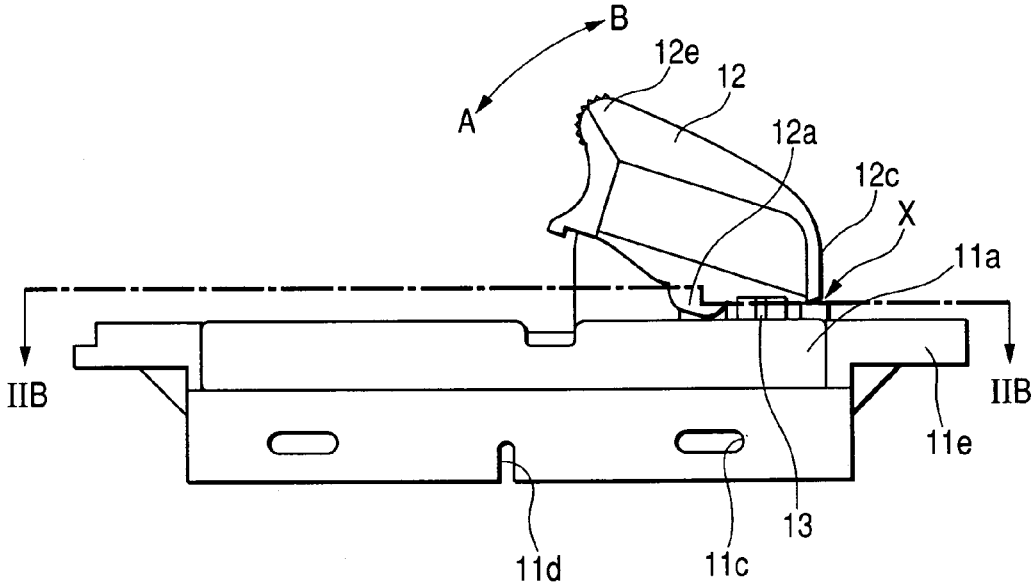
FIG. 2A is a front view of the switch device shown in FIG. 1.
Figure 2B:
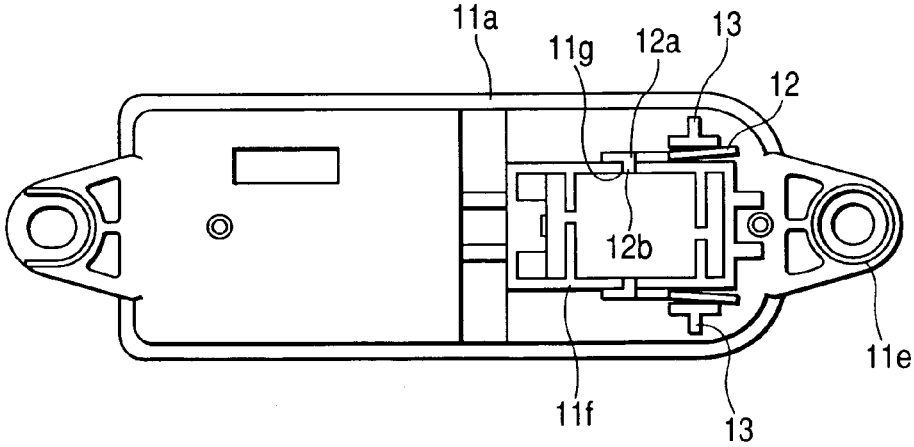
FIG. 2B is a cross-sectional view taken along the line IIB—IIB of FIG. 2A.

Hereinafter, a preferred embodiment of the invention will be described with reference to the accompanying drawings. FIG. 1 is a perspective view showing the construction of a switch device according to an embodiment of the invention. FIG. 2A is a front view of the switch device shown in FIG. 1, and FIG. 2B is a cross-sectional view taken along the line IIB—IIB of FIG. 2A. The switch device 1 shown in FIG. 1 is mainly formed by a switch housing 11 having an operation member receiving part, and an operation member 12 mounted on the operation member receiving part of the switch housing 11.

The switch housing 11 made of a synthetic resin has a housing main body 11*a* formed in a rectangular parallelepiped shape. The housing main body 11*a* is mounted on a lower housing (not shown) which is assembled into the housing main body 11*a* so as to accommodate movable contacts (not shown) or fixed contacts (not shown) therein. The lower housing is made of synthetic resin, and has protrusions (not shown) to be snap-engaged with engaging holes 11*c* of the housing main body 11*a*. Further, a plurality of slits 11*d* is formed in a lower part of the housing main body 11*a*, protrusions (not shown) formed in the lower housing are inserted in the slits 11*d* so as to serve as a guide, so that the protrusions are positioned in a direction orthogonal to a formation direction (a direction of a longer side of the slit 11*d* shown in FIG. 1) of the slit 11*d*. Furthermore, an end portion in the direction of the longer side of the housing main body 11*a* is provided with a fastening part 11*e* for screwing the switching device with respect to other members.

In the vicinity of the fastening part 11*e* on one side of the top surface of the housing 11, there is provided an operation member receiving part 11*f* formed of a wall having an engaging hole 11*g* that is a first engaging part. That is, as shown in FIG. 2A, the operation member receiving part 11*f* is formed by four walls so as to have a substantially rectangular shape, and the respective walls are connected to each other at each end portion. In addition, the operation member receiving part 11*f* has a hollow portion therein. In the present embodiment, as shown in FIG. 2B, the engaging holes 11*g* are respectively formed at a pair of walls facing each other of the operation member receiving part 11*f* along a longer side of the switch housing 11. The size of the engaging hole 11*g* is properly set such that the engaging hole 11*g* is engaged with an engaging protrusion 12*b* of the operation member 12 to be described later, and the operation member 12 seesaws about an engaged region of the engaging hole 11*g* and the engaging protrusion 12*b* as a fulcrum.

The operation member 12 made of a synthetic resin has the engaging protrusion 12*b* (see FIG. 2B) that is a second engaging part to be engaged with the engaging hole 11*g* (see FIG. 2B) that is a first engaging part. The operation member 12 is mounted on the switch housing 11 such that the operation member 12 covers the operation member receiving part 11*f* as the engaging hole 11*g* is engaged with the engaging protrusion 12*b*, that is, the operation member receiving part 11*f* is positioned inside the operation member 12, and the operation member 12 seesaws about the engaged region where the engaging hole 11*b* is engaged with the engaging protrusion 12*b* as a fulcrum. The operation member 12 has substantially a box shape whose one side is opened, and the operation member 12 can be mounted on the switch housing 11 by having the opened side face toward the switch housing 11. In addition, at the pair of side walls of the operation member facing each other, extension parts 12*a* extending toward the switch housing 11 protrude such that the width of the extension part 12*a* becomes small in a direction toward the front end thereof. The extension part 12*a* is formed such that the thickness thereof becomes small in a direction toward the front end thereof by removing an external side of the extension part 12*a*. Further, the extension part 12*a* is provided with the engaging protrusion 12*b*. The engaging protrusion 12*b* is formed in such a size that allows the engaging protrusion 12*b* to be engaged with the engaging hole 11*g* of the operation member receiving part 11*f*. Therefore, as the engaging protrusion 12*b* of the operation member 12 is engaged with the engaging hole 11*g* of the operation member receiving part 11*f* of the switch housing 11, the operation member 12 is mounted on the switch housing 11.

In the present embodiment, the operation member 12 is provided with the engaging protrusion 12*b*, and the engaging holes 11*g* are formed at the operation member receiving part 11*f* of the switch housing 11, so that the operation member 12 is mounted on the switch housing 11 by engaging the engaging protrusion 12*b* with the engaging hole 11*g*. However, in the invention, engaging holes may be formed at the operation member 12, and the operation member receiving part 11*f* of the switch housing 11 may be provided with engaging protrusions, so that the operation member 12 may be mounted on the switch housing 11 by engaging the protrusions with the engaging holes. In addition, instead of the engaging hole, engaging recessed part to be engaged with the engaging protrusion may be formed at the operation member 12 or the operation member receiving part 11*f*, so that the operation member 12 may be mounted on the switch housing 11 by engaging the engaging protrusion with the recessed part. In this case, when the engaging recessed part is formed at the operation member receiving part 11*f*, it is not necessary to form holes at the operation member receiving part 11*f*, and thus the inside of the switch housing 11 can be protected from moisture or the like.

When viewed from the longer side of the switch housing 11, the switch housing 11 has a convex regulation wall 13 (which extends from the housing main body 11*a* in a substantially vertical direction thereto in FIG. 1) between the engaged region and a predetermined region X where an end (front end 12*c*) of the operation member 12 is brought into contact with the switch housing 11 by performing the seesaw operation of the operation member 12. On the other hand, since the front end 12*c* being in contact with the predetermined region X needs to function as a stopper, the front end 12*c* should have a sufficient rigidity. Therefore, when the operation member 12 is snap-engaged with the switch housing 11, or when the operation member 12 is disengaged from the switch housing 11 due to a large amount of load, the predetermined region X is not deformed, but the remaining region between the front end 12*c* and the engaging protrusion 12*b* is deformed. Accordingly, since it is assumed that the regulation wall 13 regulates the deformed region during snapping, the regulation wall 13 is disposed between the predetermined region X and the engaged region. In addition, when viewed from the longer side (in a direction orthogonal to a rotation-supporting shaft of the operation member 12) of the switch housing 11, the regulation wall 13 is positioned such that the regulation wall 13 facingly contacts the extension part 12*a* of the operation member 12 in a state in which the operation member 12 is tilted so that the front end 12*c* is in contact with the top surface (the predetermined region X) of the switch housing 11, and the regulation wall 13 does not facingly contact the extension part 12*a* of the operation member 12 when the operation member 12 is mounted on the switch housing 11. By positioning the regulation wall 13 as described above, when the operation member 12 is mounted on the switch housing 11, the regulation wall 13 does not affect the mounting operation, so that deformation in a direction which allows the operation member 12 to be disengaged from the switching housing 11 is prevented by the regulation wall 13 when an excessive amount of load is applied on the operation member 12. For example, when the engaging protrusions 12*b* are disengaged from the engaging holes 11*g*, the extension part 12*a* of the operation member 12 tends to deform outward; however, the regulation wall 13 prevents the extension part 12*a* from deforming outward. Accordingly, the operation member 12 is prevented from being disengaged from the switch housing 11. Further, in the present embodiment, the regulation wall 13 has substantially a T-shaped cross section and includes a contact 13*a* which prevents the extension part 12*a* of the operation member 12 from deforming and a support part 13*b* which supports the contact 13*a*. However, the regulation wall 13 may have any kind of shape as long as the regulation wall 13 effectively prevents the extension part 12*a* of the operation member 12 from deforming.

Further, the regulation wall should prevent the operation member 12 from deforming, in other words, the regulation wall should prevent the engaging protrusion 12*b* from being disengaged from the engaging hole 11*g* when an excessive amount of load is applied on the operation member 12. To achieve this, the regulation wall 13 is disposed in a position facing a deformation area in the vicinity of the extension 12*a* of the operation member 12 when an excessive amount of load is applied on the operation member 12. Therefore, it is preferable that the regulation wall be formed in consideration of a material or the shape of the operation member 12.

Figure 3:
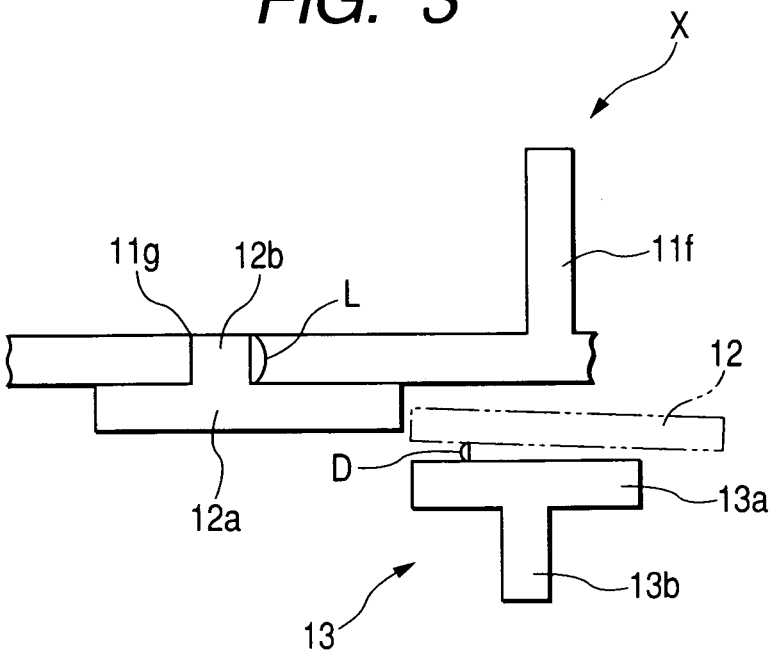
FIG. 3 is an explanatory view showing the positional relationship between an operation member and a regulation wall.

In the present embodiment, in order to satisfy the above-described conditions, it is preferable that the positional relationship between the regulation wall 13 and the extension part 12*a* of the operation member 12 be set to be as shown in FIG. 3. That is, as shown in FIG. 3, when the operation member 12 is mounted on the switch housing 11, when viewed from the top, it is preferable that the operation member receiving part 11*f* and the extension part 12*a* be positioned at a predetermined interval without overlapping each other. Further, it is preferable that a distance D between the extension part 12*a* of the operation member 12 and the regulation wall 13 be shorter than an engagement length L of the engaging hole 11*g* and the engaging protrusion 12*b*. With this setting, before the engaging protrusion 12*b* is disengaged from the engaging hole 11*g*, the regulation wall 13 can prevent the extension part 12*a* from deforming outward; therefore, the operation member 12 can be reliably prevented from being disengaged from the switch housing 11. In particular, it is preferable that the distance D be set to be ⅓ or less of the engagement length L in consideration of rocking in a protrusion direction (in the rotation-supporting shaft direction of the operation member 12) of the engaging protrusion 12*b* of the operation member 12 with respect to the operation member receiving part 11*f*.

Figure 4:
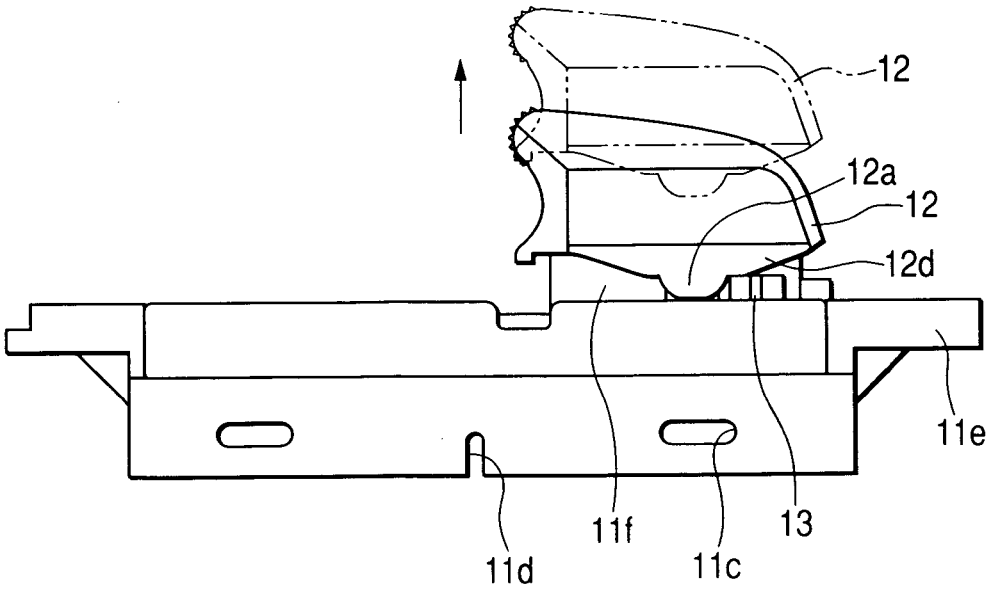
FIG. 4 is an explanatory view showing a state in which the operation member is mounted on the switch housing.
Figure 5A:
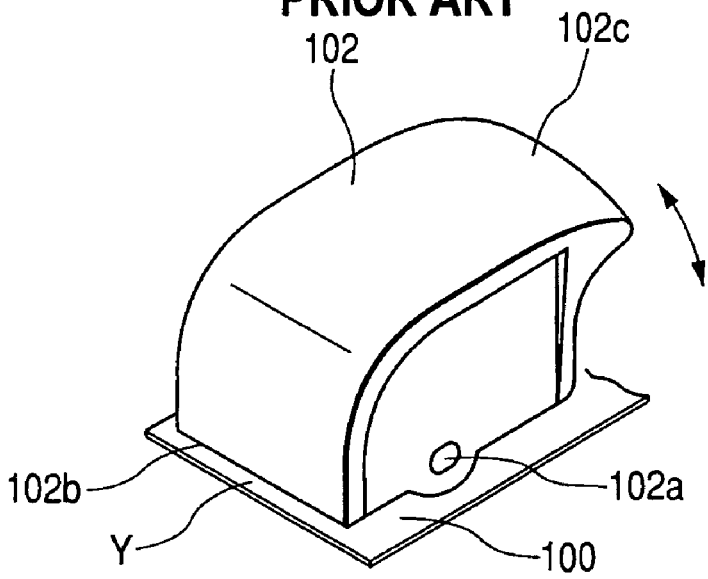
FIG. 5A PRIOR ART
FIG. 5A is a perspective view of an operation member.
Figure 5B:
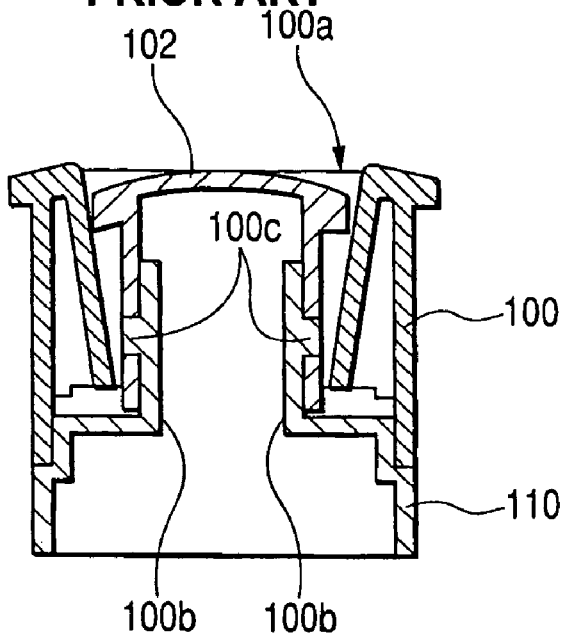
FIG. 5B PRIOR ART
FIG. 5B is a cross-section view of a switch housing on which the operation member is mounted.

Furthermore, as shown in FIG. 4, when viewed from the side in a state in which the operation member 12 is horizontally positioned, it is preferable that the height of the regulation wall 13 be set such that the regulation wall 13 does not overlap an outline 12*d* of the extension part 12*a* of the operation member 12. Accordingly, it is preferable that the shapes of the regulation wall 13 and the extension part 12*a* of the operation member 12 be properly determined so as to satisfy the above-described condition.

In the present embodiment, the switch housing 11 and the operation member 12 can be manufactured by injection molding using plastic materials. In the present embodiment, when manufacturing the switch housing 11 formed with the operation member receiving part 11*f* for supporting the operation member 12, the regulation wall 13 is integrally formed to the switch housing 11 by the injection molding. Therefore, when the operation member 12 is eventually assembled into the switch housing 11, positional accuracy between the extension part 12*a* and the regulation wall 13 can be improved. Accordingly, the extension part 12*a* is prevented from contacting the regulation wall 13 when the switch device is regularly used, and the extension part 12*a* is prevented from deforming by the regulation wall 13 when a large amount of load is applied on the operation member 12. In addition, while the operation member 12 is assembled into the switch housing 11, the regulation wall 13 does not facingly contact the extension part 12*a*. Then, when the operation member 12 is inclined so that the front end 12*c* is brought into contact with the top surface (predetermined region X) of the switch housing 11, the regulation wall 13 facingly contacts the extension part 12*a*. That is, since the height of the regulation wall 13 is low, the regulation wall 13 has a sufficient intensity to prevent the extension part 12*a* from deforming.

When the operation member 12 is mounted on the switch housing 11, as shown in FIG. 4, the operation member 12 descends in a direction opposite to the direction indicated by an arrow from above the switch housing 11 so that the engaging protrusions 12*b* of the operation member 12 are engaged (that is, snapped in) with the engaging holes 11*g* of the switch housing 11. At this time, a chamfer (not shown) is provided on an upper end portion of the operation member receiving part 11*f* or on a lower end portion of the engaging protrusion 12*b* and the engaging protrusion 12*b* of the operation member 12 goes along the wall of the operation member receiving part 11*f* of the switch housing 11, and thus the extension part 12*a* widens outward. Then, when the engaging protrusion 12*b* is engaged with the engaging hole 11*g*, the widened extension part 12*a* returns to the original position, so that the operation member 12 is rotatably mounted on the switch housing 11. At this time, the height of the regulation wall 13 is set such that the regulation wall 13, when viewed from the side, does not overlap the outline 12*d* of the extension part 12*a* of the operation member 12, and as shown in FIG. 2B and FIG. 3, when viewed from the top, the operation member 12 does not overlap the extension part 12*a*. Therefore, when the operation member 12 is mounted on the switch housing 11, the regulation wall 13 does not disadvantageously affect the mounting operation. In addition, since the extension part 12*a* is in contact with the regulation wall 13 under a state in which the front end 12*c* is close to the top surface of the switch housing 11, the engaging protrusions 12*b* cannot be engaged with the engaging holes 11*g*. Therefore, when assembled in the state, the inclination of the operation member 12 is adjusted so as to avoid the state and then the operation member 12 is assembled into the switch housing 11. In this way, the switch device according to the invention is manufactured.

As shown in FIG. 2A, when the operation member 12 is tilted in a direction indicated by an arrow A, the operation member 12 rocks like a seesaw about the engaged region between the engaging hole 11*g* and the engaging protrusion 12*b* as a fulcrum. Accordingly, a motor rotates in the normal direction, for example. In the same manner, when the operation member 12 is tilted in a direction indicated by an arrow B, the operation member 12 rocks like a seesaw about the engaged region as a fulcrum. Accordingly, the motor rotates in the reverse direction.

In FIG. 2A, when a rear end 12*e* is lifted up about the predetermined region X of the switch housing 11 as a fulcrum and is further turned in the direction indicated by the arrow B, the extension part 12*a* of the operation member 12 widens. However, before the engaging hole 12*b* is disengaged from the engaging hole 11*g*, the regulation wall 13 prevents the extension part 12*a* from deforming outward, and thus the operation member 12 is prevented from being disengaged from the switch housing 11. In this way, the switch device according to the present embodiment can prevent the operation member from falling off even though an excessive amount of load is applied thereon.

In the present embodiment, at the pair of walls facing each other in the operation member 12, the extension parts 12*a* extending toward the switch housing 11 protrude such that the width of the extension part 12*a* becomes small in a direction toward the front end thereof. The extension part 12*a* is formed such that the thickness thereof becomes small in a direction toward the front end thereof by removing an external side of the extension part 12*a*. In the meantime, the thickness of the operation member receiving part 11*f* is substantially equal to that of the pair of walls excluding the extension part 12*a* of the operation member 12. Therefore, when the operation member 12 is mounted on the switch housing 11 by the snap engagement, or when the operation member 12 is disengaged from the switch housing 11 due to a large amount of load as described above, the operation member receiving part 11*f* is rarely deformed and the extension part 12*a* is mainly deformed. Therefore, since the regulation wall can be integrally formed on the external surface of the switch housing 11, the regulation wall can be easily manufactured, as compared with the case in which the operation member receiving part 11*f* is deformably formed and the regulation wall is provided for regulating the operation member receiving part 11*f*. In addition, the amount of deformation in a region of the extension part 12*a*, where the engaging protrusion 12*b* is formed, can be substantially equal to the amount of deformation in the protrusion direction of the engaging protrusion 12*b* of the rest of the extension part 12*a*. Therefore, the amount of deformation of the extension part 12*a* except for the region where the engaging protrusion 12*b* is formed can be made large. Since the regulation wall 13 prevents the deformation which allows the operation member 12 to be disengaged from the switch housing 11, the regulation wall 13 may be positioned separate from the operation member 12 (which means that the dimension D of FIG. 3 is made large). Therefore, the maximum of possible dimension D is made large, and thus the regulation wall 13 can be easily formed.

The invention is not limited to the above-described structure. For example, the invention may use a structure in which the extension parts 12*a* extending toward the switch housing 11 protrude such that the width of the extension part 12*a* becomes small in a direction toward the front end thereof, or a structure in which the extension part 12*a* is formed such that the thickness thereof becomes small in a direction toward the front end thereof. Further, the invention may not use either structure as well. Any structure can be used as long as the regulation wall prevents the operation member from being disengaged from the switch housing without hindering the deformation of the operation member when a large amount of load is applied on an end of the operation member.

The invention is not limited to the above-described embodiment, but can be modified in various forms. The size and shape shown in the accompanying drawings are not limited to the above-described embodiment, but can be modified in various forms within the scope of the invention. The rest of the parts can also be modified in various forms within the scope of the invention.

The invention claimed is:

1. A switch device comprising:

a switch housing having an operation member receiving part composed of walls having first engaging parts, and an operation member which has second engaging parts engaged with the first engaging parts, covers the operation member receiving part by snap-engaging the second engaging part with the first engaging part, and is mounted on the switch housing such that the operation member seesaws about an engaged region of the first and second engaging parts as a fulcrum, wherein the switch housing has a regulation wall between the engaged region and a predetermined region where an end portion of the operation member is brought into contact with the switch housing by the seesaw operation, the regulation wall regulating deformation of at least one of the operation member or the switch housing.

2. The switch device according to claim 1, wherein the regulation wall prevents deformation in a direction which allows the second engaging part to be disengaged from the first engaging part, in a state in which the operation member is in contact with the switch housing.

3. The switch device according to claim 1, wherein a distance between the operation member and the regulation wall is set to be shorter than a length by which the first engaging part is engaged with the second engaging part.

4. The switch device according to claim 1, wherein the first engaging part is a recessed part, and the second engaging part is a protruding part.

* * * * *